US008393562B1

(12) United States Patent
Dunstan

(10) Patent No.: US 8,393,562 B1
(45) Date of Patent: Mar. 12, 2013

(54) PLASTIC SHREDDER

(76) Inventor: Gregory B. Dunstan, Bakersfield, CA (US)

( * ) Notice: Subject to any disclaimer, the term of this patent is extended or adjusted under 35 U.S.C. 154(b) by 200 days.

(21) Appl. No.: 12/964,816

(22) Filed: Dec. 10, 2010

(51) Int. Cl.
*B02C 23/00* (2006.01)

(52) U.S. Cl. ..... 241/100; 241/236

(58) Field of Classification Search ..... 241/100, 241/236

See application file for complete search history.

(56) References Cited

U.S. PATENT DOCUMENTS

| | | | | |
|---|---|---|---|---|
| 4,009,838 | A | 3/1977 | Tashman | |
| 4,153,206 | A | 5/1979 | Haefner et al. | |
| 4,573,641 | A | 3/1986 | DeWoolfson et al. | |
| 4,669,673 | A | 6/1987 | Lodovico et al. | |
| 4,815,669 | A * | 3/1989 | Fujii | 241/34 |
| 4,817,877 | A * | 4/1989 | Itoh et al. | 241/34 |
| 4,821,967 | A * | 4/1989 | Moriyama | 241/37.5 |
| 4,846,413 | A * | 7/1989 | Inoue | 241/236 |
| 4,871,118 | A | 10/1989 | Maloney | |
| D342,965 | S | 1/1994 | Duke et al. | |
| 6,520,435 | B1 | 2/2003 | Robinson | |
| 6,957,784 | B1 | 10/2005 | Barkan et al. | |
| 7,926,753 | B2 * | 4/2011 | Carver | 241/99 |
| 2005/0072869 | A1 * | 4/2005 | Ting | 241/100 |
| 2006/0124789 | A1 * | 6/2006 | Matlin et al. | 241/100 |

* cited by examiner

*Primary Examiner* — Faye Francis

(57) ABSTRACT

A plastic shredder is provided for shredding plastic and depositing it directly into a garbage receptacle. An interior channel extends between a top and a bottom of a housing. An upper roller and a lower roller are positioned in and extend across the interior channel. The upper roller is positioned parallel to the lower roller in spaced relationship forming a gap. Upper teeth extend from an outer surface of the upper roller. Lower teeth extend from an outer surface of the lower roller. The lower teeth mesh with the upper teeth for pulling plastic through the gap where the plastic is shredded. A lip extends outwardly from a middle section of the outer wall of the housing. The lip is positionable to engage an upper edge of a container such that the interior channel empties into the container for collecting the plastic after the plastic is shredded.

17 Claims, 7 Drawing Sheets

PLASTIC SHREDDER

BACKGROUND OF THE DISCLOSURE

Field of the Disclosure

The disclosure relates to plastic shredding devices and more particularly pertains to a new plastic shredding device for shredding plastic and depositing it directly into a garbage receptacle for compact storage prior to recycling.

SUMMARY OF THE DISCLOSURE

An embodiment of the disclosure meets the needs presented above by generally comprising a housing having a top, a bottom, and an outer wall extending between the top and the bottom. An interior channel extends between the top and the bottom. An upper roller and a lower roller are positioned in and extend across the interior channel. The upper roller is positioned parallel to the lower roller in spaced relationship forming a gap between the upper roller and the lower roller. A plurality of upper teeth extends from an outer surface of the upper roller. A plurality of lower teeth extends from an outer surface of the lower roller. The lower teeth mesh with the upper teeth. The upper teeth and the lower teeth are designed for pulling plastic through the gap where the plastic is shredded by the upper teeth and the lower teeth. A lip extends from a middle section of the outer wall of the housing. The lip is positionable to engage an upper edge of a container such that the interior channel empties into the container for collecting the plastic after the plastic is shredded.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
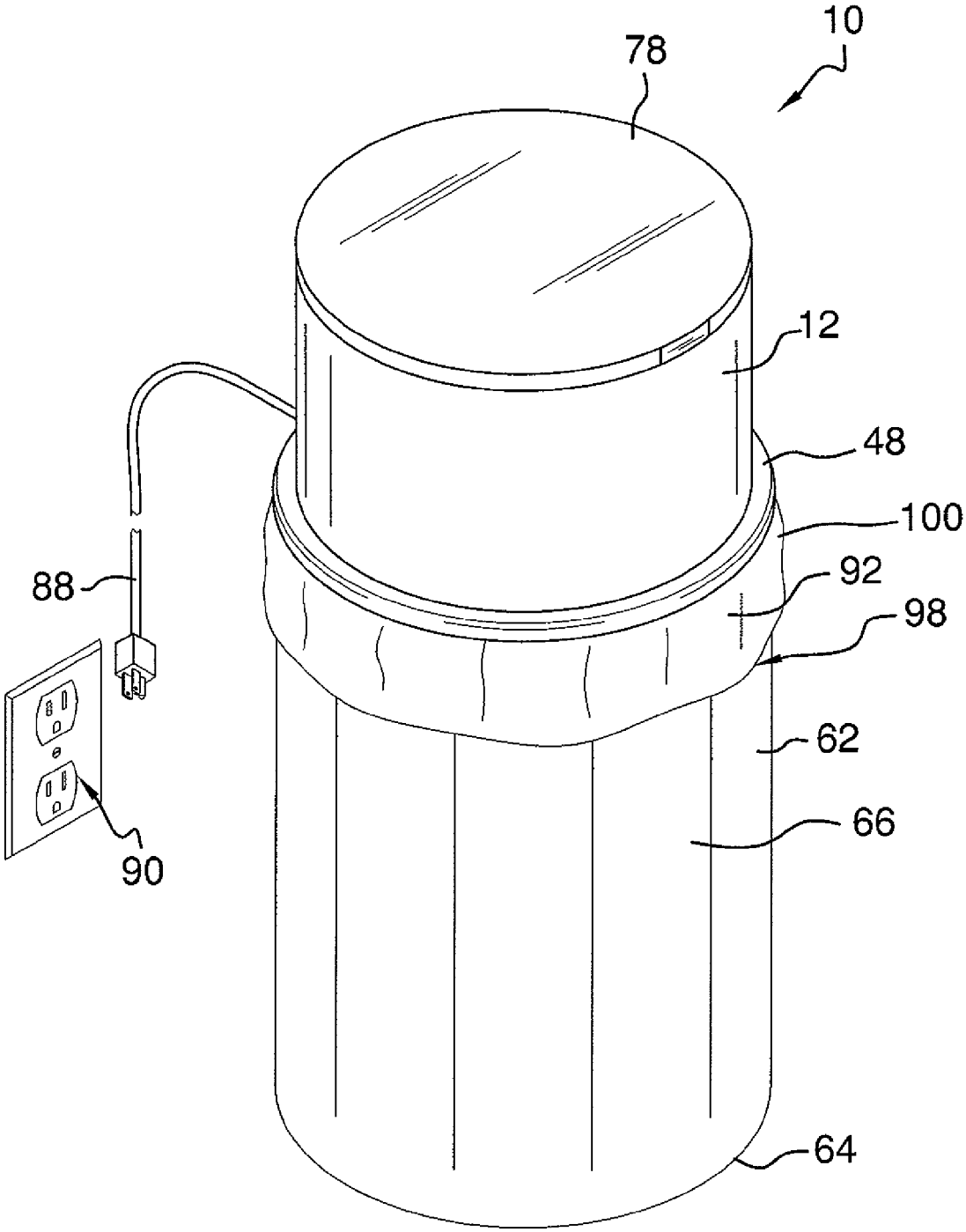
FIG. 1 is a top front side perspective view of a plastic shredder according to an embodiment of the disclosure.
Figure 2:
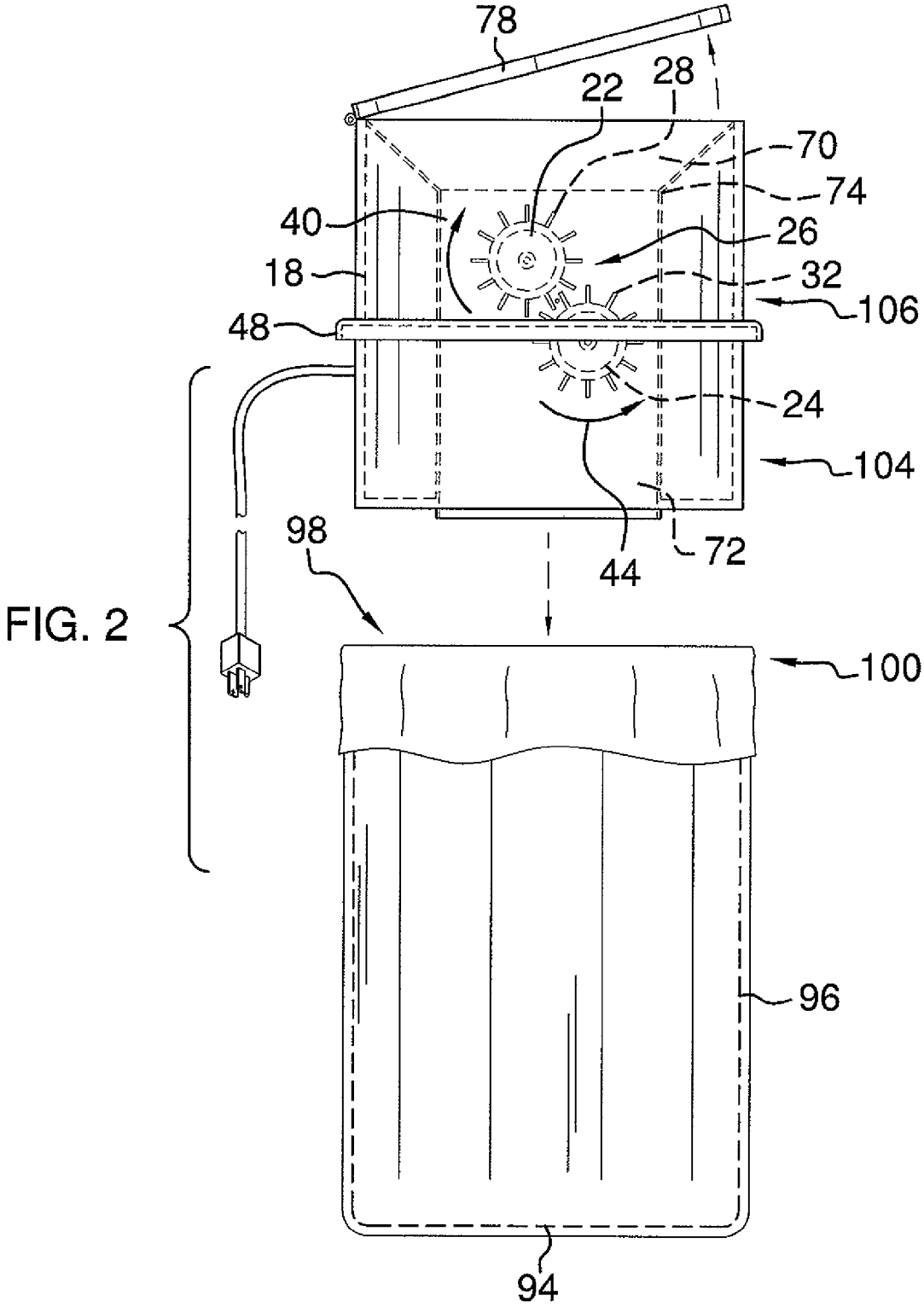
FIG. 2 is a side view of an embodiment of the disclosure.
Figure 3:
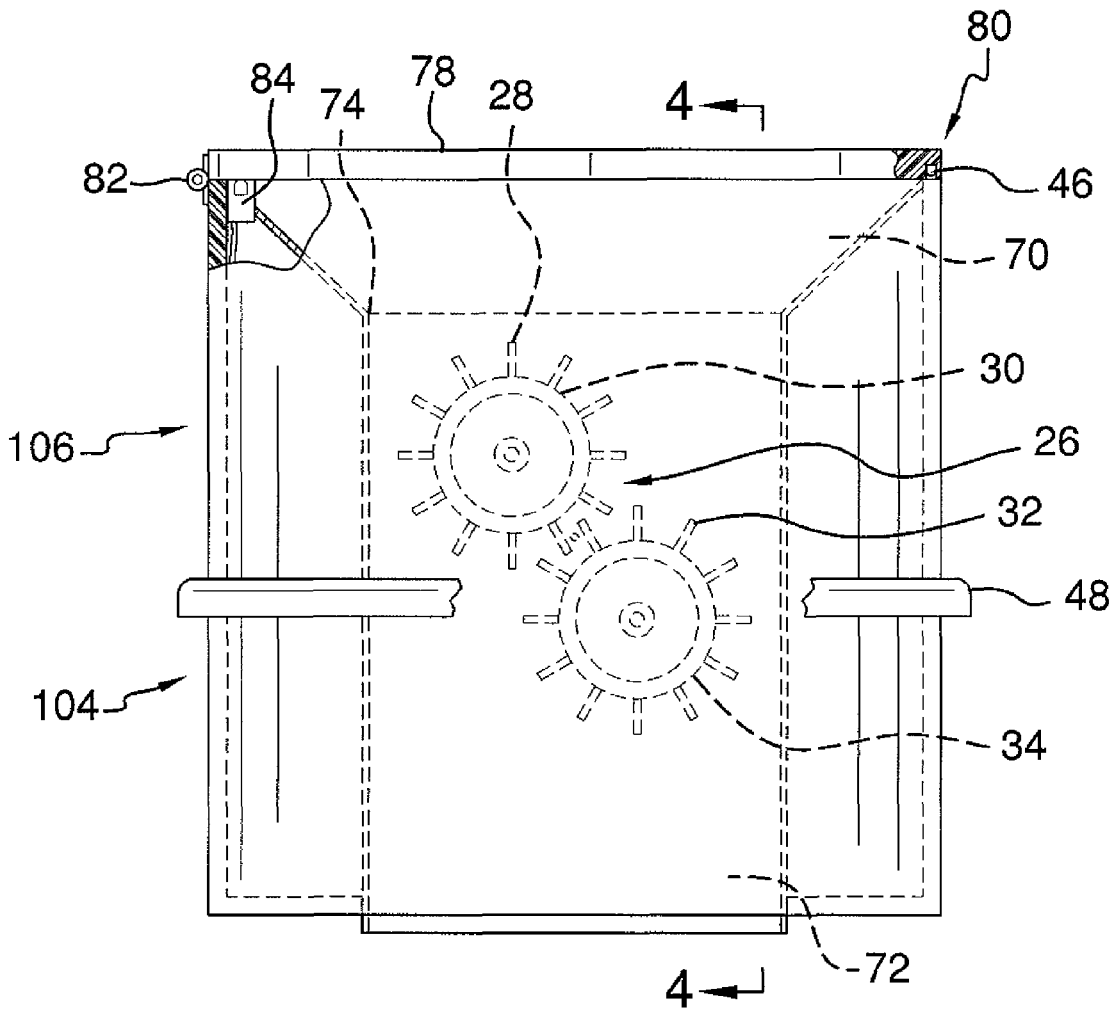
FIG. 3 is a side view of an embodiment of the disclosure.
Figure 4:
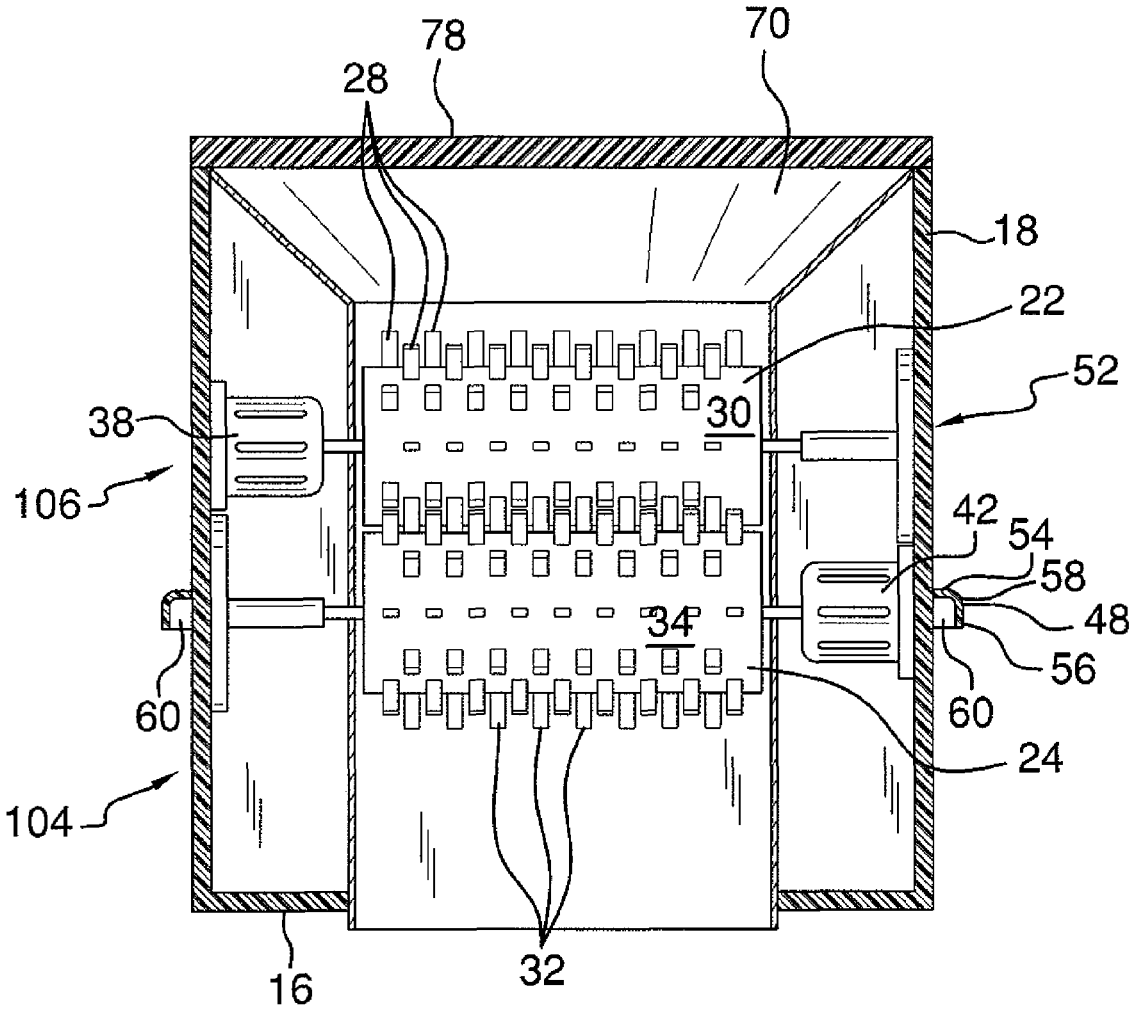
FIG. 4 is a cross-sectional view of an embodiment of the disclosure taken along line 4-4 of FIG. 3.
Figure 5:
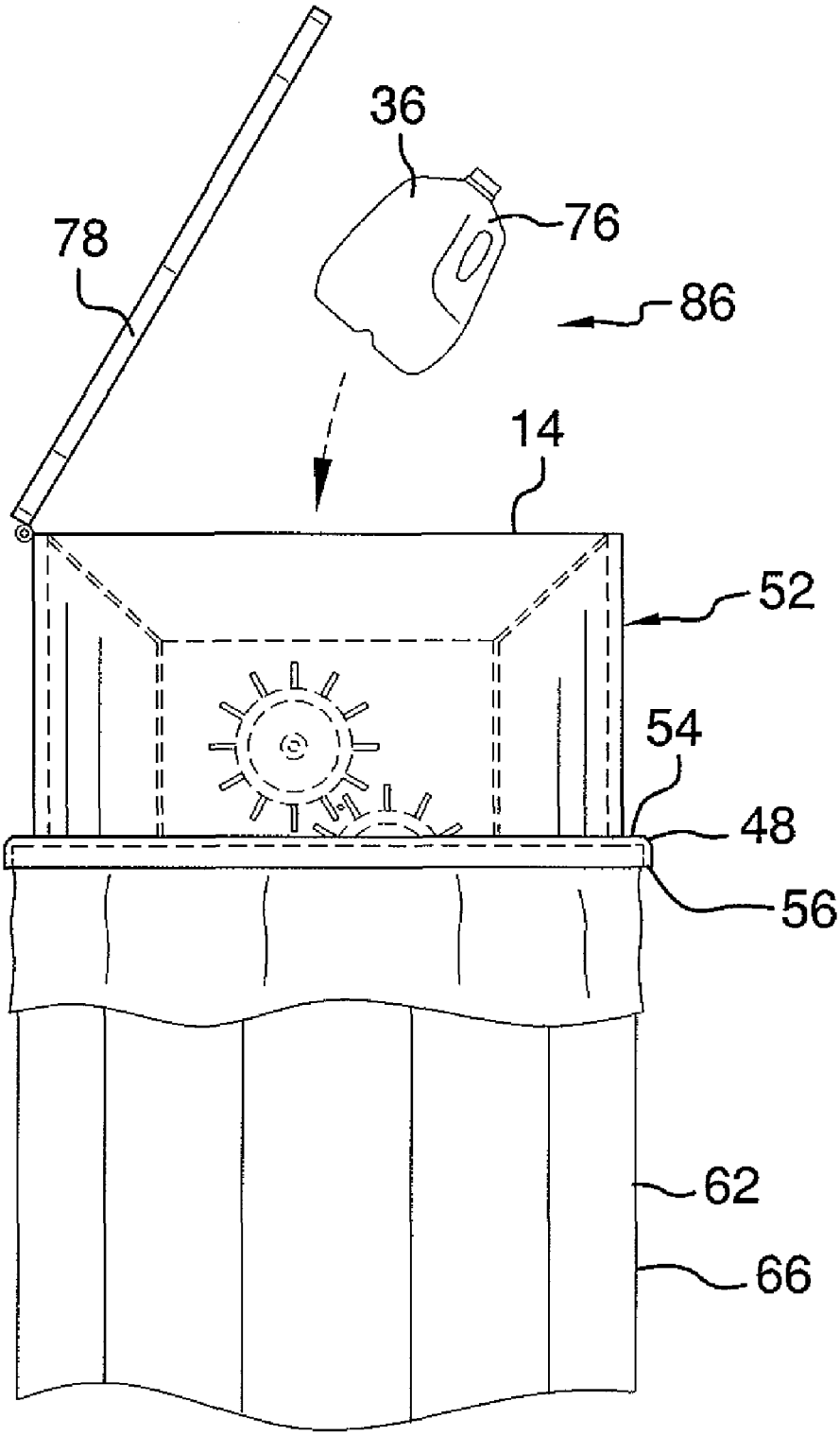
FIG. 5 is a side view of an embodiment of the disclosure.
Figure 6:
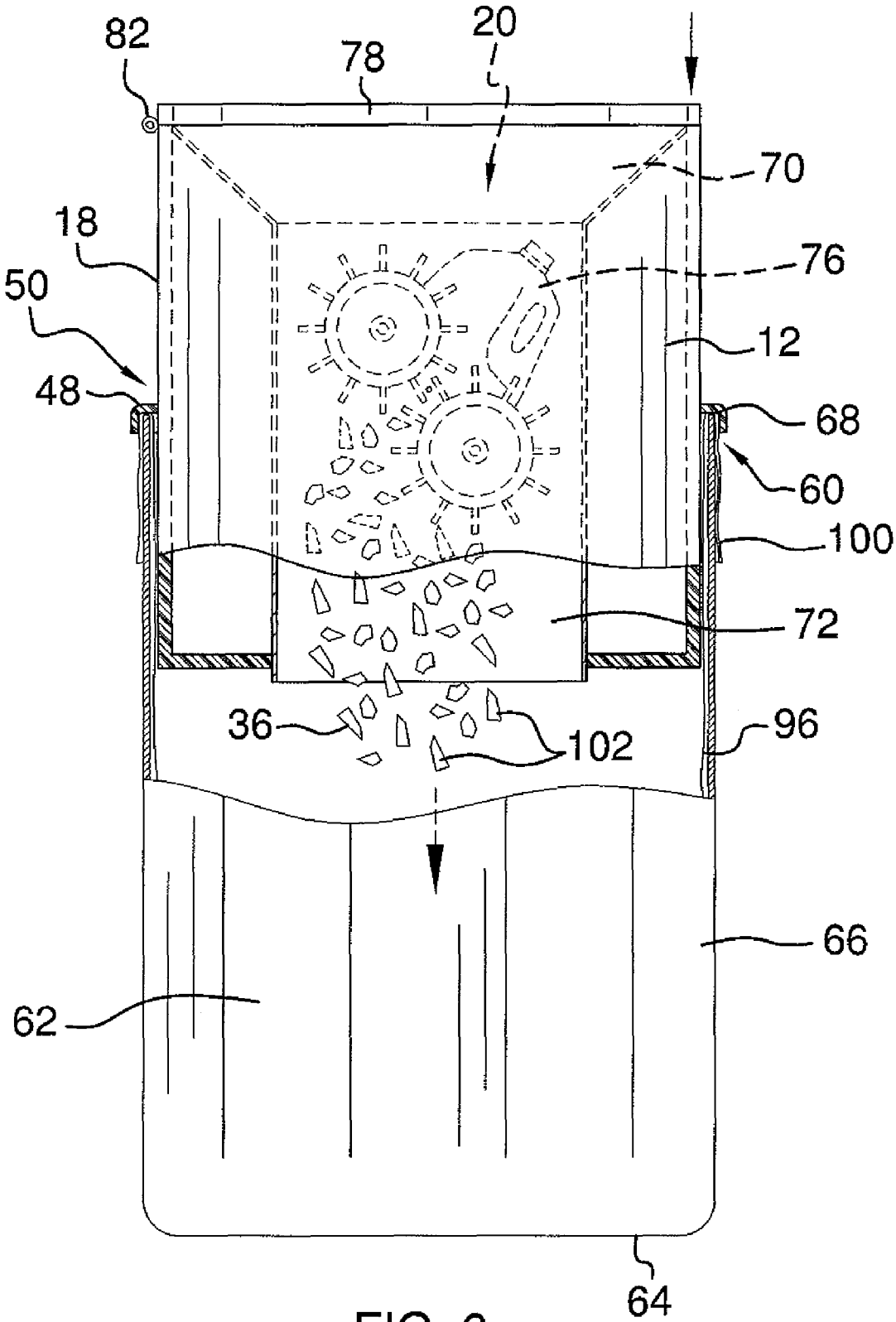
FIG. 6 is a partial cut-away side view of an embodiment of the disclosure in use.
Figure 7:
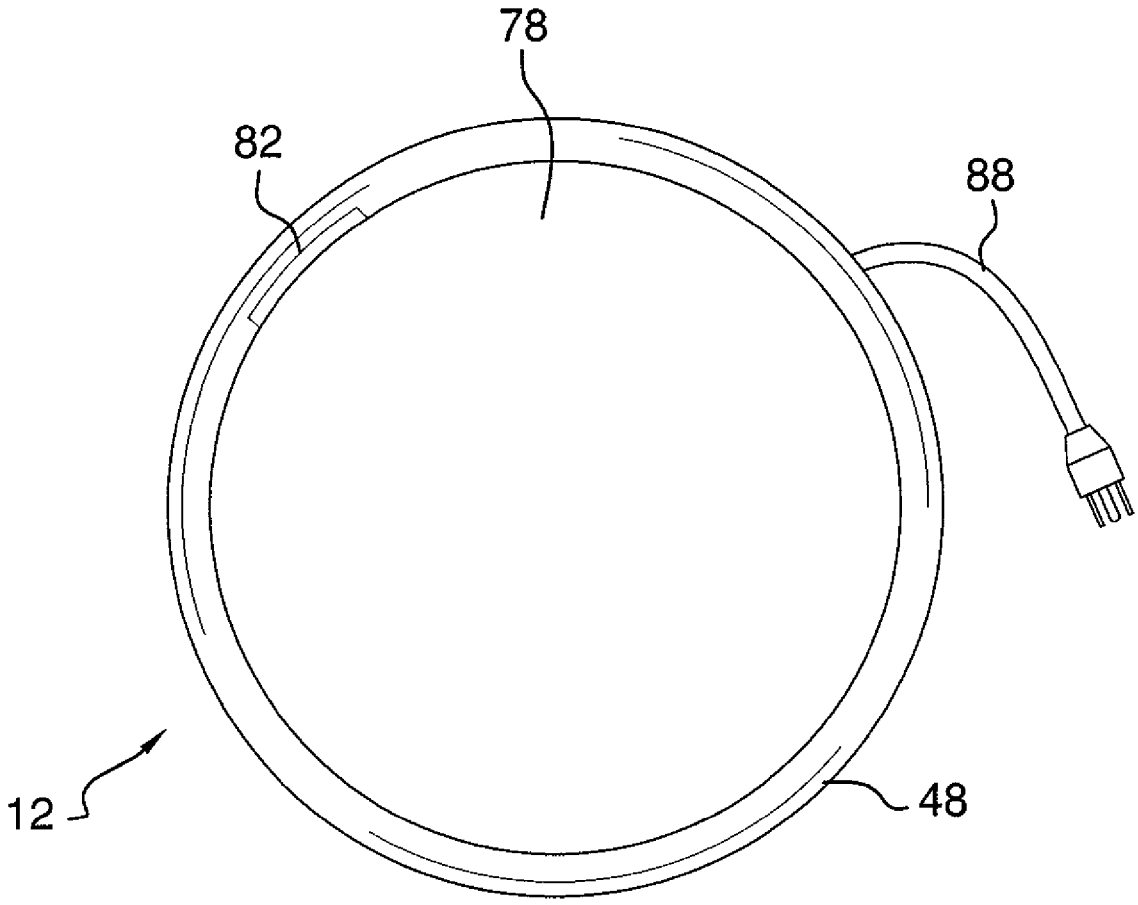
FIG. 7 is a top view of an embodiment of the disclosure.

With reference now to the drawings, and in particular to FIGS. 1 through 7 thereof, a new plastic shredding device embodying the principles and concepts of an embodiment of the disclosure and generally designated by the reference numeral 10 will be described.

As best illustrated in FIGS. 1 through 7, the plastic shredder 10 generally comprises a housing 12 having a top 14, a bottom 16, an outer wall 18 extending between the top 14 and the bottom 16, and an interior channel 20 extending between the top 14 and the bottom 16. An upper roller 22 and a lower roller 24 are each positioned in and extend across the interior channel 20. The upper roller 22 is positioned so that it is orientated parallel to the lower roller 24 in spaced relationship forming a gap 26 between the upper roller 22 and the lower roller 24. The upper roller 26 is positioned vertically higher than the lower roller 24. A plurality of upper teeth 28 extends from an outer surface 30 of the upper roller 22. A plurality of lower teeth 32 extends from an outer surface 34 of the lower roller 24. The lower teeth 32 mesh with the upper teeth 28. The upper teeth 28 and the lower teeth 32 are designed for pulling plastic 36 through the gap 26. The plastic 36 is shredded by the upper teeth 28 and the lower teeth 32.

An upper motor 38 is positioned in the housing 12. The upper motor 38 is operationally coupled to the upper roller 22 for selectively rotating the upper roller 22 in a first direction 40. A lower motor 42 is positioned in the housing 12. The lower motor 42 is operationally coupled to the lower roller 24 for selectively rotating the lower roller 24 in a second direction 44 opposite the first direction 40. The upper roller 22 and the lower roller 24 are designed for urging the plastic 36 positioned above the lower roller 24 through the gap 26 between the upper roller 22 and the lower roller 24.

A pressure switch 46 is coupled to the housing 12. The pressure switch 46 is operationally coupled to the upper motor 38 and the lower motor 42 for selectively activating the upper motor 38 and the lower motor 42.

A lip 48 extends from a middle section 50 of the outer wall 18 of the housing 12. The lip 48 extends continuously around an exterior surface 52 of the housing 12. The lip 48 includes a top portion 54 extending outwardly from the exterior surface 52 of the housing 12. The lip 48 further includes an outer portion 56 extending from a distal edge 58 of the top portion 54 of the lip 48 relative to the housing 12. The outer portion 56 of the lip 48 is parallel to the exterior surface 52 of the housing 12 forming a groove 60.

A container 62 has a closed bottom 64 and a perimeter wall 66 extending upwardly from the closed bottom 64 to form an upper edge 68. The lip 48 is positionable to rest on the upper edge 68 of the container 62 while the upper edge 68 is positioned in the groove 60 such that the interior channel 20 empties into the container 62. Thus, the container 62 is designed for collecting the plastic 36 after the plastic 36 is shredded.

A funnel portion 70 of the interior channel 20 extends downwardly and inwardly from the top 14 of the housing 12. A straight portion 72 of the interior channel 20 extends downwardly from a lower edge 74 of the funnel portion 70. The upper roller 22 and the lower roller 24 are positioned in the straight portion 72 of the interior channel 20. The upper roller 22 is positioned proximate the lower edge 74 of the funnel portion 70. The lower roller 24 is positioned in vertically offset alignment with the upper roller 22. Thus, plastic 36 such as a bottle 76 is directed onto the lower roller 24 by the upper roller 22. The lower roller 24 directs the bottle 76 back towards the upper roller 22 where the upper teeth 28 and the lower teeth 32 work together to pull the bottle 76 through the gap 26

A lid 78 is positioned on the top 14 of the housing 12. The pressure switch 46 extends from the top 14 of the housing 12 and is positioned adjacent to the lid 78. Thus, applying downward pressure to the lid 78 adjacent the pressure switch 46 when the lid 78 is in a closed position 80 actuates the pressure switch 46. A hinge 82 is coupled between the lid 78 and the housing 12 such that the lid 78 is pivotally coupled to the housing 12. A kill switch 84 is coupled to the housing 12 adjacent to the lid 78 near the hinge 82. The kill switch 84 is operationally coupled to the upper motor 38, the lower motor 42 and the lid 78 such that the kill switch 84 renders the upper motor 38 and the lower motor 42 inoperable while the lid 78 is in an open position 86. A power cord 88 is operationally coupled to the upper motor 38 and the lower motor 42. The power cord 88 is designed for coupling to an electrical outlet 90.

A liner 92 has a closed bottom 94, a continuous sidewall 96 extending from the closed bottom 94 terminating in a top liner edge 96 forming a liner opening 98. The liner 92 is positionable in the container 62. A top section 100 proximate the top liner edge 96 extends over the upper edge 68 of the container 62. The top section 100 of the liner 92 is positionable between the upper edge 68 of the container 62 and the lip 48. Thus, the liner 92 is designed to receive shards 102 of plastic 26 after the plastic 26 has passed through the gap 36.

A lower section 104 of the housing 12 extends downwardly from the lip 48. The lower section 104 of the housing 12 is complimentary to an upper section 106 of the container 62 extending downwardly from the upper edge 68 of the container 62. The lower section 104 of the housing 12 is thereby snugly received in the upper section 106 of the container 62 for stabilizing the housing 12 during use.

In use, the liner 92 is positioned in the container 62. The housing 12 is positioned on the container 62 with the upper edge 68 received in the groove 60. The bottle 76 is positioned in the interior channel 20. The funnel portion 70 urges the bottle 76 towards the upper roller 22 and lower roller 24. The lid 78 is closed to prevent the kill switch 84 from disabling the upper motor 38 and the lower motor 42. Pressure is applied to the lid 78 to engage the pressure switch 46 which engages the upper motor 38 and the lower motor 42. Rotation of the rollers 22,24 urges the bottle 76 through the gap 36 where it is shredded by teeth 28,32. The shards 102 then fall through the interior channel 20 into the liner 92. The shards 102 are significantly more compact and thus easier to transport or store as desired.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A plastic shredding assembly comprising:

a housing having a top, a bottom, an outer wall extending between said top and said bottom, and an interior channel extending between said top and said bottom;

an upper roller and a lower roller, said upper roller and said lower roller being positioned in and extending across said interior channel, said upper roller being positioned parallel to said lower roller in spaced relationship forming a gap between said upper roller and said lower roller, said top and bottom being open and bounding a central axis, said central axis being vertically oriented, said central axis extending between an axis of rotation of said upper roller and an axis of rotation of said lower roller;

a plurality of upper teeth extending from an outer surface of said upper roller;

a plurality of lower teeth extending from an outer surface of said lower roller, said lower teeth meshing with said upper teeth whereby said upper teeth and said lower teeth are configured to pull plastic through said gap whereby the plastic is shredded by said upper teeth and said lower teeth;

a lip extending from a middle section of said outer wall of said housing, said upper roller being vertically positioned above a plane of said lip; and a container having a closed bottom and a perimeter wall extending upwardly from said closed bottom to form an upper edge, said lip being positionable to engage said upper edge of said container such that said interior channel empties into said container whereby said container is configured to collect the plastic after the plastic is shredded.

2. The assembly of claim 1, further comprising:

an upper motor positioned in said housing, said upper motor being operationally coupled to said upper roller for selectively rotating said upper roller; and a lower motor positioned in said housing, said lower motor being operationally coupled to said lower roller for selectively rotating said lower roller.

3. The assembly of claim 2, further including a switch coupled to said housing, said switch being operationally coupled to said upper motor and said lower motor for selectively activating said upper motor and said lower motor.

4. The assembly of claim 1, wherein said lip extends continuously around said exterior surface of said housing.

5. The assembly of claim 4, wherein said lip includes a top portion extending outwardly from said exterior surface of said housing, said lip further including an outer portion extending from a distal edge of said upper portion of said lip relative to said housing, said outer portion of said lip being parallel to said exterior surface of said housing forming a groove receiving said upper edge of said container.

6. The assembly of claim 1, wherein said interior channel includes a funnel portion and a straight portion, said funnel portion extending downwardly and inwardly from said top of said housing, said straight portion extending downwardly from a lower edge of said funnel portion.

7. The assembly of claim 6, wherein said upper roller and said lower roller are positioned in said straight portion of said interior channel, said upper roller being proximate said lower edge of said funnel portion.

8. The assembly of claim 7, wherein said lower roller is positioned in vertically offset alignment with said upper roller.

9. The assembly of claim 3, further comprising:

a lid;

a hinge coupled between said lid and said housing such that said lid is pivotally coupled to said housing; and said switch being a pressure switch positioned adjacent to said lid whereby applying pressure to said lid adjacent said pressure switch when said lid is in a closed position actuates said pressure switch.

10. The assembly of claim 9, further including a kill switch coupled to said housing adjacent to said lid, said kill switch being operationally coupled to said upper motor, said lower motor and said lid such that said kill switch renders said upper motor and said lower motor inoperable while said lid is in an open position.

11. The assembly of claim 2, further including said upper motor rotating said upper roller in a first direction, said lower motor rotating said lower roller in a second direction opposite said first direction whereby said rollers are configured to urge the plastic positioned above said lower roller through said gap between said upper roller and said lower roller.

12. The assembly of claim 1, further including a power cord operationally coupled to said upper motor and said lower motor, said power cord being configured to be coupled to an electrical outlet.

13. The assembly of claim 1, further including a liner having a closed bottom, a continuous sidewall extending from said closed bottom terminating in an top liner edge forming a liner opening, said liner being positionable in said container, a top section proximate said top liner edge extending over said upper edge of said container, said top section of said liner being positionable between said upper edge of said container and said lip whereby said liner is configured to receive shards of plastic after the plastic has passed through said gap.

14. The assembly of claim 1, further including a lower section of said housing extending downwardly from said lip, said lower section of said housing being complimentary to an upper section of said container extending downwardly from said upper edge of said container whereby said lower section of said housing is snugly received in said upper section of said container for stabilizing said housing during use.

15. A plastic shredding assembly comprising:

a housing having a top, a bottom, an outer wall extending between said top and said bottom, and an interior channel extending between said top and said bottom;

an upper roller and a lower roller, said upper roller and said lower roller being positioned in and extending across said interior channel, said upper roller being positioned parallel to said lower roller in spaced relationship forming a gap between said upper roller and said lower roller;

a plurality of upper teeth extending from an outer surface of said upper roller;

a plurality of lower teeth extending from an outer surface of said lower roller, said lower teeth meshing with said upper teeth whereby said upper teeth and said lower teeth are configured to pull plastic through said gap whereby the plastic is shredded by said upper teeth and said lower teeth;

an upper motor positioned in said housing, said upper motor being operationally coupled to said upper roller for selectively rotating said upper roller in a first direction;

a lower motor positioned in said housing, said lower motor being operationally coupled to said lower roller for selectively rotating said lower roller in a second direction opposite said first direction whereby said rollers are configured to urge the plastic positioned above said lower roller through said gap between said upper roller and said lower roller;

a pressure switch coupled to said housing, said pressure switch being operationally coupled to said upper motor and said lower motor for selectively activating said upper motor and said lower motor;

a lip extending from a middle section of said outer wall of said housing, said lip extending continuously around said exterior surface of said housing, said lip including a top portion extending outwardly from said exterior surface of said housing, said lip further including an outer portion extending from a distal edge of said upper portion of said lip relative to said housing, said outer portion of said lip being parallel to said exterior surface of said housing forming a groove;

a container having a closed bottom and a perimeter wall extending upwardly from said closed bottom to form an upper edge, said lip being positionable to engage said upper edge of said container in said groove such that said interior channel empties into said container whereby said container is configured to collect the plastic after the plastic is shredded;

a funnel portion of said interior channel extending downwardly and inwardly from said top of said housing;

a straight portion of said interior channel extending downwardly from a lower edge of said funnel portion, wherein said upper roller and said lower roller are positioned in said straight portion of said interior channel, said upper roller being positioned proximate said lower edge of said funnel portion, wherein said lower roller is positioned in vertically offset alignment with said upper roller;

a lid, said pressure switch being positioned adjacent to said lid whereby applying pressure to said lid adjacent said pressure switch when said lid is in a closed position actuates said pressure switch;

a hinge coupled between said lid and said housing such that said lid is pivotally coupled to said housing;

a kill switch coupled to said housing adjacent to said lid, said kill switch being operationally coupled to said upper motor, said lower motor and said lid such that said kill switch renders said upper motor and said lower motor inoperable while said lid is in an open position;

a power cord operationally coupled to said upper motor and said lower motor, said power cord being configured to be coupled to an electrical outlet;

a liner having a closed bottom, a continuous sidewall extending from said closed bottom terminating in an top liner edge forming a liner opening, said liner being positionable in said container, a top section proximate said top liner edge extending over said upper edge of said container, said top section of said liner being positionable between said upper edge of said container and said lip whereby said liner is configured to receive shards of plastic after the plastic has passed through said gap; and a lower section of said housing extending downwardly from said lip, said lower section of said housing being complimentary to an upper section of said container extending downwardly from said upper edge of said container whereby said lower section of said housing is snugly received in said upper section of said container for stabilizing said housing during use.

16. A plastic shredding assembly comprising:

a housing having a top, a bottom, an outer wall extending between said top and said bottom, and an interior channel extending between said top and said bottom;

an upper roller and a lower roller, said upper roller and said lower roller being positioned in and extending across said interior channel, said upper roller being positioned parallel to said lower roller in spaced relationship forming a gap between said upper roller and said lower roller;

a plurality of upper teeth extending from an outer surface of said upper roller;

a plurality of lower teeth extending from an outer surface of said lower roller, said lower teeth meshing with said upper teeth whereby said upper teeth and said lower teeth are configured to pull plastic through said gap whereby the plastic is shredded by said upper teeth and said lower teeth;

a lip extending from a middle section of said outer wall of said housing;

a container having a closed bottom and a perimeter wall extending upwardly from said closed bottom to form an upper edge, said lip being positionable to engage said upper edge of said container such that said interior channel empties into said container whereby said container is configured to collect the plastic after the plastic is shredded;

a switch coupled to said housing to activate rotation of said upper and lower rollers;

a lid;

a hinge coupled between said lid and said housing such that said lid is pivotally coupled to said housing; and said switch being a pressure switch positioned adjacent to said lid, said lid being positioned on said pressure switch when said lid is in a closed position, whereby applying pressure to said lid adjacent said pressure switch when said lid is in said closed position actuates said pressure switch.

17. The assembly of claim 16, further including a kill switch coupled to said housing adjacent to said lid, said kill switch rendering said upper and lower rollers inoperable when said lid in said open position.

* * * * *